US007056175B2

(12) United States Patent
Högström

(10) Patent No.: US 7,056,175 B2
(45) Date of Patent: Jun. 6, 2006

(54) ROWING DEVICE

(76) Inventor: Bo Högström, Bergomsvägen 9, Ramvik (SE)

( * ) Notice: Subject to any disclaimer, the term of this patent is extended or adjusted under 35 U.S.C. 154(b) by 7 days.

(21) Appl. No.: 10/489,171

(22) PCT Filed: Sep. 23, 2002

(86) PCT No.: PCT/SE02/01718

§ 371 (c)(1),
(2), (4) Date: Mar. 10, 2004

(87) PCT Pub. No.: WO03/026956

PCT Pub. Date: Apr. 3, 2003

(65) Prior Publication Data

US 2004/0235370 A1 Nov. 25, 2004

(30) Foreign Application Priority Data

Sep. 25, 2001 (SE) ..... 01031830

(51) Int. Cl.
*B63H 16/06* (2006.01)

(52) U.S. Cl. ..... 440/104

(58) Field of Classification Search ..... 482/72, 482/73; 440/101–110; 416/74
See application file for complete search history.

(56) References Cited

U.S. PATENT DOCUMENTS

| | | | | |
|---|---|---|---|---|
| 981,439 | A * | 1/1911 | Livingston | 440/108 |
| 2,987,736 | A | 6/1961 | Wolff | |
| 5,630,739 | A * | 5/1997 | Mele | 440/102 |
| 2003/0041377 | A1 * | 3/2003 | Bailey | 5/118 |
| 2004/0256776 | A1 | 12/2004 | Champ | |

FOREIGN PATENT DOCUMENTS

| | | | |
|---|---|---|---|
| DE | 154571 | C | 10/1904 |
| DE | 1556842 | A | 2/1970 |
| WO | 99/38767 | A1 | 8/1999 |

* cited by examiner

*Primary Examiner*—Ed Swinehart
(74) *Attorney, Agent, or Firm*—Nixon & Vanderhye P.C.

(57) ABSTRACT

Equipment for assisting in rowing a boat with oars comprising an active means (5) of receiving, storing and releasing energy, which receives the energy conveyed from the rower to the oar (4) during the return movement of the oar blade. The means (5) releases the energy with a certain degree of damping in order to prevent uncontrolled movement of the oar (4) during its forward movement.

19 Claims, 2 Drawing Sheets

ROWING DEVICE

This application is a US national phase of international application PCT/SE02/01718 filed in Swedish on 23 Sep. 2002, which designated the United States. PCT/SE02/01718 claims priority to SE Application No. 0103183-0 filed 25 Sep. 2001. The entire contents of these applications are incorporated herein by reference.

The present invention concerns an aid for rowing a boat according to the preamble to claim 1.

Rowing is performed with two different movements, partly a forward movement with the oar blades below the surface of the water with the resistance of the oar blades in the water driving the boat in the direction of travel, and partly a return movement where the oar blades are transported above the surface of the water to their original positions ready to be lowered into the water for starting a new forward movement again. Previously known means supply energy to a spring or rubber band during the return movement that is released during the forward movement, thereby giving the rower additional power. The said means has the disadvantage that if the rower loses grip of the oar once the spring or rubber band has been supplied with energy, the oar handle can hit the rower in an uncontrollable manner, causing personal injury.

One object of the present invention is to alleviate or remedy such shortcomings.

This object is achieved by supplying energy to a gas-filled piston-cylinder means, primarily a gas cylinder, during the return movement so that it can be released in a controllable manner during the forward movement and thereby provide the additional power. The gas cylinder works so that the added energy is released with a certain degree of damping, whereby it can be released in a controlled manner, reducing the risk of personal injury. Tests have shown that the forward movement of a normal oar stroke during competition rowing is completed in 0.6 seconds, which is why the speed of the outgoing movement of the gas cylinder piston rod has been set to 0.5 seconds. This means that even if the rower should lose grip of the oar, even if the oar is in the air, it will not move faster than it would during a normal stroke.

Figure 1:
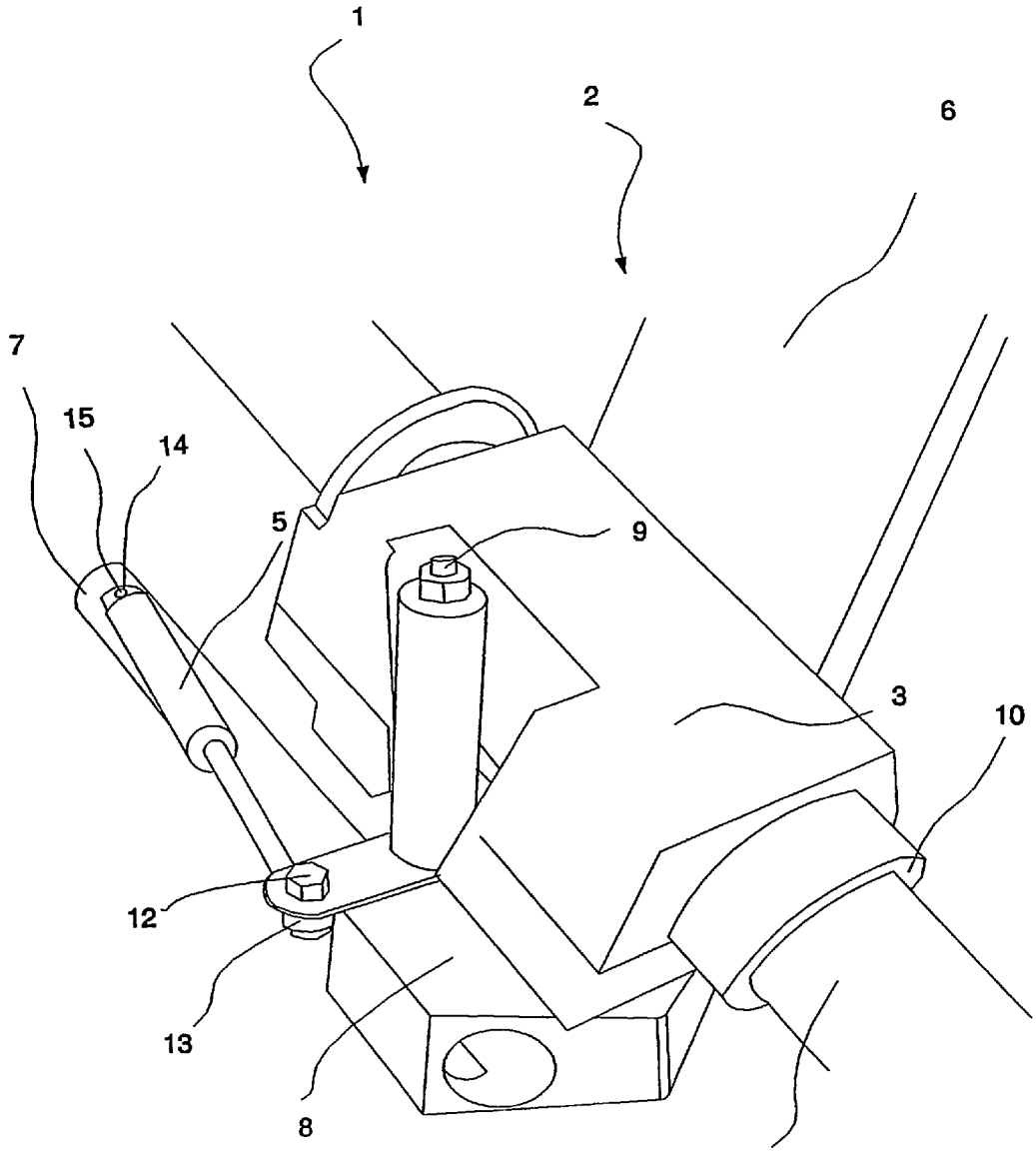
Figure 2:
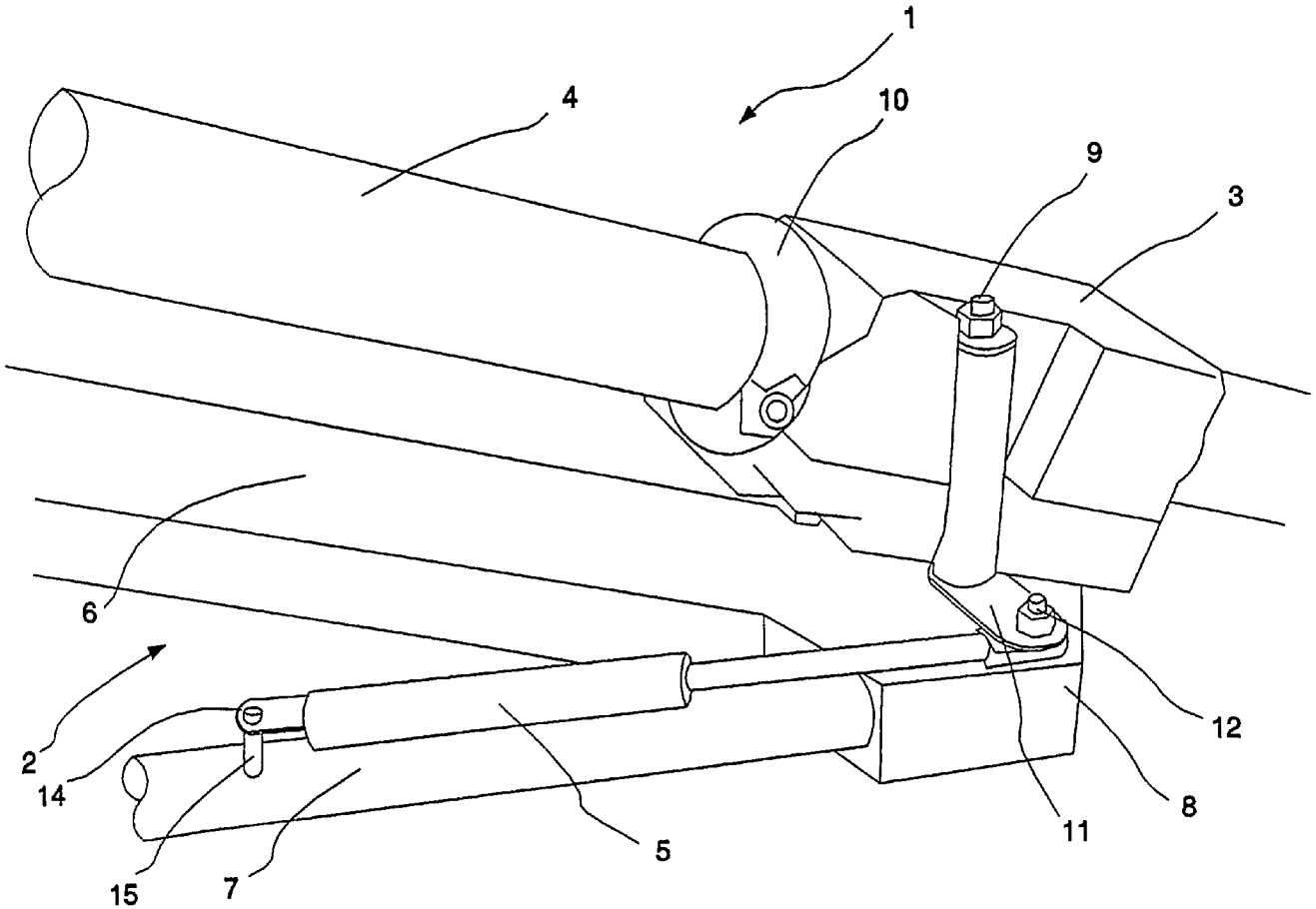

The invention is described more fully in the following with reference to the attached drawings, which illustrate examples of selected embodiments, where FIG. 1 is a side view of the equipment in accordance with the invention and FIG. 2 is a detailed drawing of one oar mounted in a holder to which the aid is arranged seen from the front.

The rowing equipment 1 illustrated in FIGS. 1 and 2 comprises one pair of stands arranged on a boat, each exhibiting a holder 3 for one oar 4 and a means of receiving/storing/releasing energy in the form of a gas cylinder 5. The stands 2 are directed outward in different directions from the railing and each stand 2 comprises one pair of stays 6, 7, one end of each being mounted to the railing at a distance from each other and the other end in a direction toward the other and finished with a joint 8. To the joint 8 is arranged an ascending shaft 9, to which the holder 3 for the oar 4 is arranged. The holder 3 comprises a tubular part 10, into which the oar is fitted and is pivoted around the shaft 9 to allow the ends of the oars 4 to perform their forward and return movements. To the holder 3 is arranged a lever 11 with a fastening point 12, to which the gas cylinder 5 piston rod attachment 13 is joined. The second fastening point 14 of the cylinder 5 is arranged on a projecting attachment 15 arranged on the front 7 stay, seen from the direction of travel of the boat, which means the cylinder 5 is angled towards the stem of the boat.

The equipment operates in the following manner:

The rower sits facing the rear of the boat with the oars 4 held straight out from the boat. The oars, seen in the direction of travel of the boat, are moved forward in the air and convey muscle energy to the gas cylinders 5. When the oar blades reach their maximum forward position, they are lowered into the water. As the oar handles are pulled forward by the rower with the oar blades under the surface of the water, the stored energy in the gas cylinders 5 is released to the oars 4, whereby the boat is driven in the direction of travel with the aid of the power from the rower as well as from the gas cylinders 5.

It should be understood that the equipment can be used with the rower sitting facing both the rear of the boat as well as the front of the boat.

The present invention is not limited to the above description and as illustrated in the drawings but can be changed and modified in a number of different ways within the framework of the idea of invention specified in the following claims.

The invention claimed is:

1. Equipment for assisting in rowing a boat with at least one oar having a blade, comprising an active structure to receive and store energy conveyed from a rower to the oar during the return movement of the oar blade, wherein the energy is released with a certain degree of damping in order to prevent uncontrolled movement of the oar during its forward movement, and wherein the active structure comprises a gas-filled piston-cylinder to receive and store energy when the gas is compressed by the return movement of the oar and to controllably release the stored energy over time during forward movement of the oar, even if the rower should lose grip of the oar and even if the oar is in the air.

2. Equipment according to claim 1, wherein the release of energy by the piston-cylinder causes the oar to rotate around its pivot during the forward movement of the oar for a predetermined time that is somewhat shorter than the time it takes to rotate the oar during a normal unassisted stroke.

3. Equipment according to claim 1, further comprising a stand, to which a pivot attachment for an oar is arranged, between which stand and pivot attachment the piston-cylinder acts.

4. Equipment according to claim 1, wherein the forward, controlled movement of the oar under the influence of the gas filled piston-cylinder occurs for a first predetermined time duration that is slightly less than a second predetermined time duration associated with an unassisted stroke of the oar.

5. Equipment according to claim 4, wherein the first predetermined time duration is about 0.5 seconds, and the second predetermined time duration is about 0.6 seconds.

6. Equipment according to claim 4, wherein the first predetermined time duration is about 80% of the second predetermined time duration.

7. Equipment according to claim 1, wherein the certain degree of damping ensures that the controlled release of the stored energy will not cause the oar to move substantially faster than the oar would during the normal unassisted stroke.

8. Equipment for assisting in backwards-facing rowing a boat with at least one oar having a blade, comprising an active structure to receive, store and release energy conveyed from a rower to the oar during the return movement of the oar blade, wherein the energy is released with a certain degree of damping in order to prevent uncontrolled movement of the oar during its forward movement and to controllably release the stored energy over time during forward movement of the oar, even if the rower should lose grip of the oar and even if the oar is in the air.

9. Equipment according to claim 8, wherein the active structure comprises a gas-filled piston-cylinder to receive and store energy when the gas is compressed by the return movement of the oar.

10. Equipment according to claim 9, wherein the release of energy by the piston cylinder causes the oar to rotate around its pivot during the forward movement of the oar for a predetermined time that is somewhat shorter than the time it takes to rotate the oar during one stroke performed without the present equipment.

11. Equipment according to claim 10, further comprising a stand to which a pivot attachment for an oar is arranged, between which stand and pivot attachment the piston-cylinder acts.

12. Equipment according to claim 9, further comprising a stand to which a pivot attachment for an oar is arranged, between which stand and pivot attachment the piston-cylinder acts.

13. Equipment according to claim 8, further comprising a holder including tubular end parts adapted to support the oar.

14. Equipment according to claim 13, wherein the holder includes a recess.

15. Equipment according to claim 14, wherein the recess is adapted to receive a shaft.

16. Equipment according to claim 14, further comprising a lever that links one end of the piston-cylinder to the shaft.

17. Equipment according to claim 16, further comprising a front stay adapted to support a second end of the piston-cylinder.

18. Equipment according to claim 8, wherein the piston-cylinder is angled towards a stem of the boat.

19. Equipment according to claim 8, wherein the certain degree of damping ensures that the controlled release of the stored energy will not cause the oar to move substantially faster than the oar would during the normal unassisted stroke.

* * * * *